US011419380B2

(12) United States Patent
Shaffer et al.

(10) Patent No.: US 11,419,380 B2
(45) Date of Patent: Aug. 23, 2022

(54) HELMET WITH FRONT END FIT SYSTEM ELASTIC CONNECTORS

(71) Applicant: Bell Sports, Inc., Scotts Valley, CA (US)

(72) Inventors: Samuel J. Shaffer, Santa Cruz, CA (US); Rafael T. Ramirez, Santa Clara, CA (US)

(73) Assignee: Bell Sports, Inc., Scotts Valley, CA (US)

( * ) Notice: Subject to any disclaimer, the term of this patent is extended or adjusted under 35 U.S.C. 154(b) by 71 days.

(21) Appl. No.: 16/530,821

(22) Filed: Aug. 2, 2019

(65) Prior Publication Data

US 2020/0046057 A1 Feb. 13, 2020

Related U.S. Application Data

(60) Provisional application No. 62/716,471, filed on Aug. 9, 2018.

(51) Int. Cl.
*A42B 3/14* (2006.01)

(52) U.S. Cl.
CPC ..... *A42B 3/14* (2013.01)

(58) Field of Classification Search
CPC ..... A42B 3/063; A42B 3/064; A42B 3/085; A42B 3/10; A42B 3/125; A42B 3/145; A42B 3/147; A42B 3/14
See application file for complete search history.

(56) References Cited

U.S. PATENT DOCUMENTS

2004/0255370 A1* 12/2004 Moeller ..... A42B 3/085 2/416
2005/0262619 A1 12/2005 Musal et al.
2015/0089724 A1* 4/2015 Berry ..... A42B 3/064 2/414
2017/0347736 A1* 12/2017 Penner ..... A42B 3/085
2019/0357623 A1 11/2019 Willinger

FOREIGN PATENT DOCUMENTS

GB 2557748 A 6/2018

OTHER PUBLICATIONS

Extended European Search Report cited in corresponding European Application No. 19190757.5 dated Jan. 9, 2020.

* cited by examiner

*Primary Examiner* — Sally Haden
(74) *Attorney, Agent, or Firm* — Walter M. Egbert, III; Richard J. Brown; Reed Smith LLP

(57) ABSTRACT

A helmet may include an outer liner and an inner liner disposed inward from the outer liner, the inner liner comprising an inner surface with at least one hole. A fit belt may comprise at least one pin coupled to an inner surface of the inner liner with the at least one hole mateably coupled with the at least one pin. An elastomeric strap may comprise an inner end and an outer end opposite the inner end. The outer end of the elastomeric strap may be coupled to an inner surface of the outer liner. The outer end of the elastomeric strap may comprise a recess and a fastener that extends through the recess of the outer end of the elastomeric strap to couple the elastomeric strap to the outer liner. The inner end of the elastomeric strap may be coupled to the fit belt.

13 Claims, 7 Drawing Sheets

HELMET WITH FRONT END FIT SYSTEM ELASTIC CONNECTORS

CROSS REFERENCE TO RELATED APPLICATION(S)

This application claims the benefit of and priority to U.S. Provisional Patent Application No. 62/716,471, filed Aug. 9, 2018, the entire contents of which are hereby incorporated by reference herein.

TECHNICAL FIELD

The invention generally relates to a protective helmet, such as a protective bicycle helmet, and more particularly to a protective bicycle helmet having inner an inner liner and an outer liner coupled together with an elastomeric strap.

BACKGROUND

A physical impact to the head of a person may cause serious injury or death. To reduce the probability of such consequences, protective gear, such as a helmet, is often used in activities that are associated with an increased level of risk for a head injury. Examples of such activities include, but are not limited to, skiing, snowboarding, bicycling, rollerblading, rock climbing, skate boarding, and motorcycling. In general, a helmet is designed to maintain its structural integrity and stay secured to the head of a wearer during an impact.

Accordingly, for example, a bicycle helmet is designed to protect the cyclist's (or wearer's) head, including by absorbing and dissipating energy during an impact with a surface, such as the ground. Bicycle helmet interiors include impact attenuating materials such as an arrangement of padding and/or foam, wherein the impact attenuating materials cover and contact a significant portion of the wearer's head. However, even with these attenuating materials, the user may still suffer injury. In addition, depending on the location of the impact on the helmet, the helmet may be completely removed from the user's head, despite the use of chin straps, because of the rigid nature of the helmet and straps that are used.

SUMMARY

The present disclosure is directed to a protective helmet that includes a number of improvements. Therefore, in some aspects, a helmet may include an outer liner. An inner liner may be disposed inward from and nested within the outer liner such that the outer liner is stacked on top of the inner liner, the inner liner comprising an inner surface with at least one hole. A fit belt comprising at least one pin may be coupled to an inner surface of the inner liner with the at least one hole mateably coupled with the at least one pin. An elastomeric strap may comprise an inner end and an outer end opposite the inner end. The outer end of the elastomeric strap may be coupled to an inner surface of the outer liner, the outer end of the elastomeric strap comprising a recess and a fastener that extends through the recess of the outer end of the elastomeric strap to couple the elastomeric strap to the outer liner. The inner end of the elastomeric strap may be coupled to the fit belt.

The helmet may further include a slip plane disposed between an inner surface of the outer liner and an outer surface of the inner liner. The slip plane may comprise mating surfaces of the inner liner and the outer liner and further comprise a low friction thermoplastic material. One or more of the outer liner and the inner liner may be formed of expanded polystyrene (EPS), expanded polypropylene (EPP), or expanded polyolefin (EPO). The inner liner and the outer liner may comprise mating spherical surfaces which aid in allowing the mating spherical surfaces of the inner liner and of the outer liner to rotate in relation to each other in any direction. The elastomeric strap may provide relative movement between the outer liner and the inner liner in a range of 0-30 millimeters (mm). The ends of the fit belt may be inserted into a fit system that adjusts the perimeter of the fit belt by drawing in or letting out the ends of the fit belt. The elastomeric strap may be coupled to the inner liner and the outer liner at points located along a lower edge of the helmet.

In other aspects, a helmet may include an outer liner. An inner liner may be disposed inward from and nested within the outlet liner. A fit belt may be coupled to an inner surface of the inner liner. An elastomeric strap may comprise an inner end and an outer end opposite the inner end. The outer end of the elastomeric strap may be coupled to an inner surface of the outer liner. The inner end of the elastomeric strap may be coupled to the fit belt.

The helmet may further include the inner liner and the outer liner comprise mating surfaces comprising a spheroid, ovoid, or ellipsoid contour which aids in allowing the mating surfaces of the inner liner and of the outer liner to rotate in relation to each other in at least one desired direction. The inner liner and the outer liner comprise mating surfaces comprising a low friction material. The outer end of the elastomeric strap may comprise a recess, and a fastener may extend through the recess of the outer end of the elastomeric strap to couple the elastomeric strap to the outer liner. The first liner and second liner may be formed of a crushable foam. The elastomeric strap may provide relative movement between the outer liner and the inner liner in a range of 0-30 mm. The elastomeric strap may be coupled to the inner liner and the outer liner at points located along a lower edge of the helmet.

In yet other aspects, a helmet may include a first liner. a second liner may be disposed such that the first liner is stacked on top of the second liner. A fit belt may be coupled to an inner surface of the second liner. An elastomeric strap may comprise a first end and a second end opposite the first end. The first end of the elastomeric strap may be coupled to an inner surface of the first liner. The second end of the elastomeric strap may be coupled to the fit belt.

The helmet may further include the first liner and the second liner comprising mating surfaces comprising a spheroid, ovoid, or ellipsoid contour which aids in allowing the mating surfaces of the first liner and of the second liner to rotate in relation to each other in at least one desired direction. The first liner and the second liner may comprise mating surfaces comprising a low friction material. The outer end of the elastomeric strap may comprise a recess. A fastener may extend through the recess of the outer end of the elastomeric strap to couple the elastomeric strap to the first liner. The elastomeric strap may be coupled to the first liner and the second liner at points located along a lower edge of the helmet. The ends of the fit belt may be inserted into a fit system that adjusts the perimeter of the fit belt by drawing in or letting out the ends of the fit belt.

While it is desirable that a protective helmet prevents injuries from occurring, it should be noted that due to the nature of recreational or competitive use, no helmet, including the present helmet, can completely prevent injuries. It should be further noted that no protective equipment can completely prevent injuries to a cyclist, particularly when such equipment is improperly used, or when the cyclist disobeys the rules of the road or engages in other reckless or dangerous conduct. When properly worn, the present helmet is believed to offer protection to cyclists, but it is believed that no helmet can, or will ever, totally and completely prevent injuries to bicyclists.

Other features and advantages of the invention will be apparent from the following specification taken in conjunction with the following drawings.

BRIEF DESCRIPTION OF THE DRAWINGS

The disclosure will now be described by way of example, with reference to the accompanying drawings.

Figure 1:
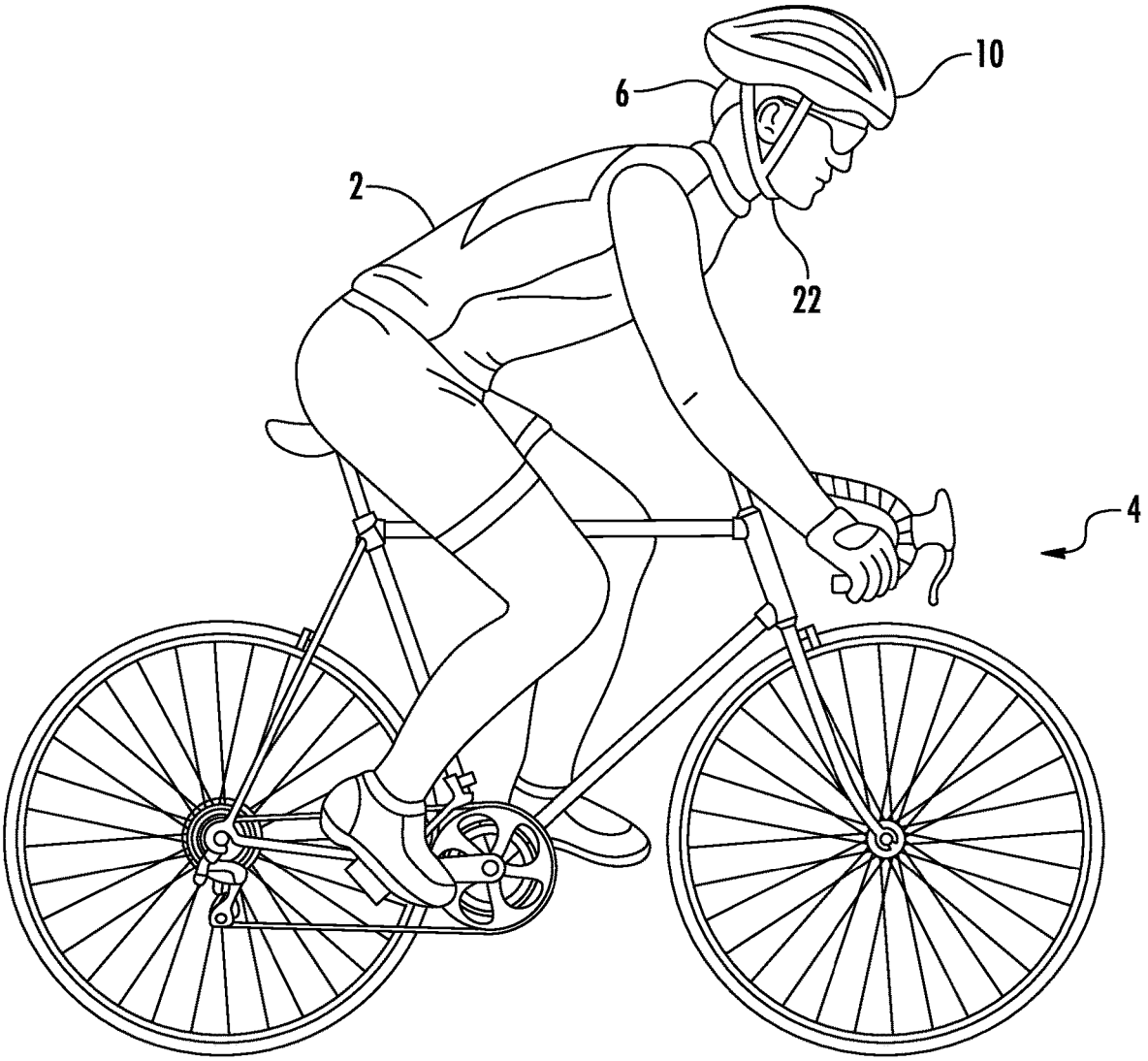
FIG. 1 illustrates a bicyclist wearing a bicycle helmet.

While the disclosed helmet will be described in connection with the illustrated embodiments shown and described herein, a person of ordinary skill in the art (POSA) will understand that the descriptions with respect to the drawings are by way of illustration, and not by limitation. On the contrary, the description is intended to cover all alternatives, modifications, and equivalents, as may be included within the spirit and scope of the appended claims.

DETAILED DESCRIPTION

This disclosure, its aspects and implementations, are not limited to the specific material types, components, methods, or other examples disclosed herein. Many additional material types, components, methods, and procedures known in the art are contemplated for use with particular implementations from this disclosure. Accordingly, for example, although particular implementations are disclosed, such implementations and implementing components may comprise any components, models, types, materials, versions, quantities, and/or the like as is known in the art for such systems and implementing components, consistent with the intended operation.

The word "exemplary," "example," or various forms thereof are used herein to mean serving as an example, instance, or illustration. Any aspect or design described herein as "exemplary" or as an "example" is not necessarily to be construed as preferred or advantageous over other aspects or designs. Furthermore, examples are provided solely for purposes of clarity and understanding and are not meant to limit or restrict the disclosed subject matter or relevant portions of this disclosure in any manner. It is to be appreciated that a myriad of additional or alternate examples of varying scope could have been presented, but have been omitted for purposes of brevity.

While this disclosure includes a number of implementations in many different forms, there is shown in the drawings and will herein be described in detail particular implementations with the understanding that the present disclosure is to be considered as an exemplification of the principles of the disclosed methods and systems, and is not intended to limit the broad aspect of the disclosed concepts to the implementations illustrated.

FIG. 1 illustrates a side view of a cyclist, user, or wearer 2 riding a bicycle 4 and wearing the inventive bicycle helmet 10 of the present disclosure. The helmet 10 is secured to the head of the user, wearer, or cyclist 6 by a chinstrap assembly 22. As the cyclist 2 and bicycle 4 move, the helmet 10 provides energy management for the wearer 2, should undesired contact or an impact occur, such as during a crash or accident.

Figure 2A:
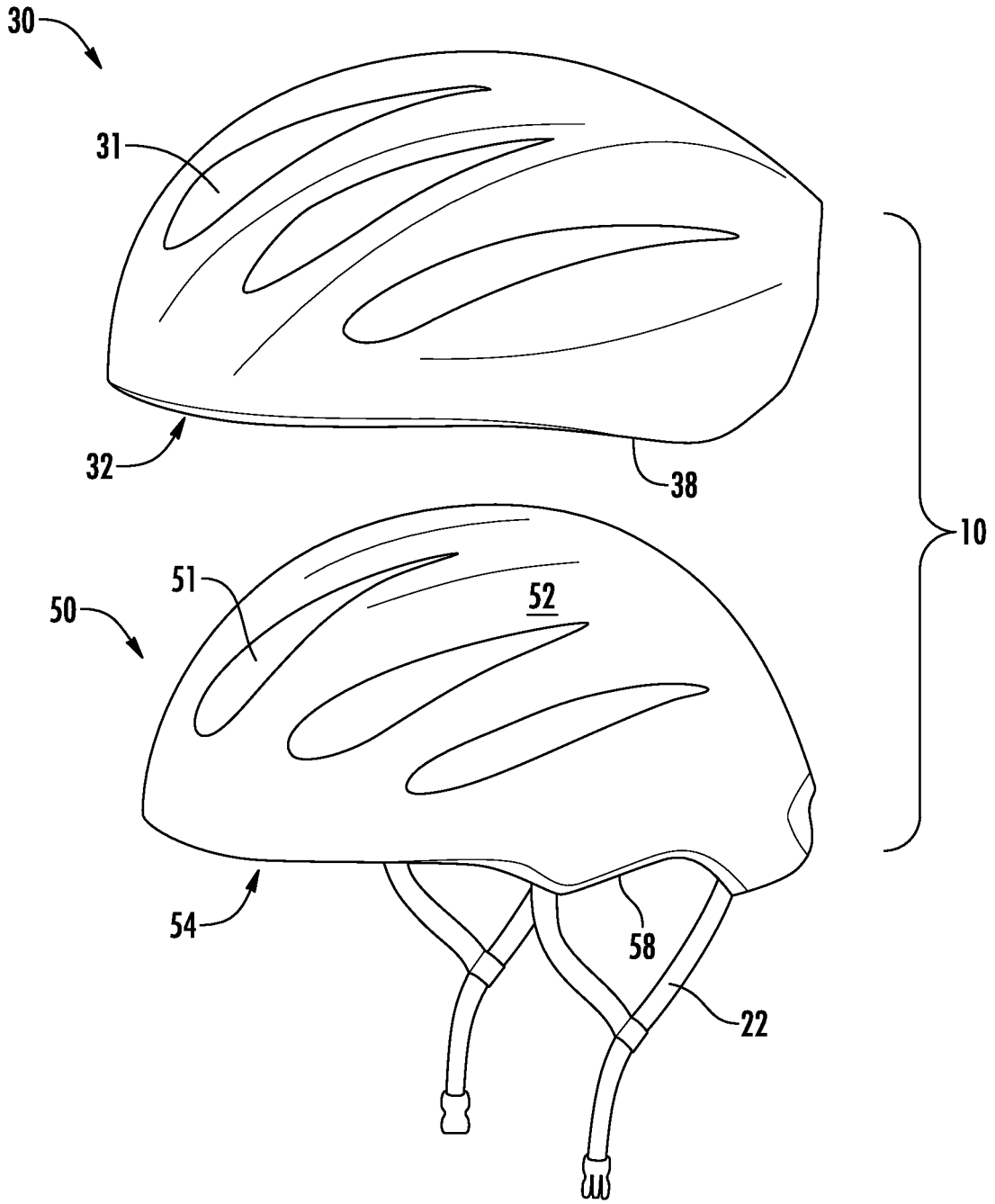
FIGS. 2A-2C illustrate various views of a helmet comprising an inner liner and an outer liner.

FIG. 2A illustrates a perspective view of the helmet 10, from FIG. 1 comprising an outer liner or first liner 30 and an inner liner or second liner 50, with the outer liner 30 separated from, and disposed over, the inner liner 50. The outer liner 30 and the inner liner 50 may be formed of a crushable foam, such as EPS, EPP, or EPO.

The inner liner 50 is disposed below, inward from, and nested within, the outer liner 30 such that the outer liner 30 is stacked on top of the inner liner 50, the inner liner 50. The outer liner 30 may comprise one or more vents 31 that allow ventilation to pass through the helmet 10 and cool the user 6. The outer liner 30 also comprises an inner surface 32, and an outer surface 34 opposite the inner surface 32. The inner surface 32 may comprise a hole or recess 36 (shown e.g. in FIG. 7) and further comprises a lower edge 38, which may be adjacent the fit belt 70 and the one or more holes 56 and elastomeric straps 90 (shown, e.g., in FIGS. 7-9).

Similarly, the inner liner 50 may comprise one or more vents 51 that allow ventilation to pass through the helmet 10 and cool the user 6. The inner liner 50 also comprises an outer surface 52, and an inner surface 54 opposite the inner surface 52. The inner surface 54 may comprise a hole 56 for receiving pin 76 of fit belt 70 (as shown, e.g., in FIG. 8). The outer surface 52 of inner liner 50 may also comprise one or more holes 57 for receiving optional additional elastomeric straps 90 for coupling the outer liner 30 to the inner liner 50, such as with fasteners 120 (see, e.g., in FIGS. 2B-2C).

Figure 7:
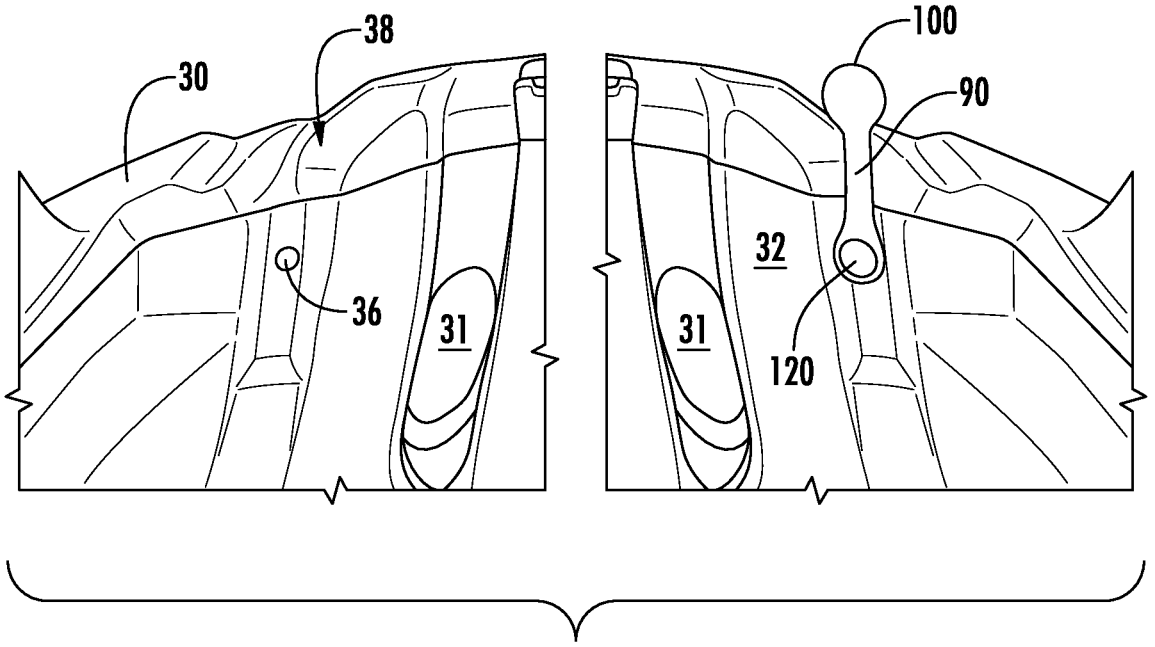
FIG. 7 shows a perspective view of an elastomeric strap coupled to an inner surface of the outer liner.
Figure 8:
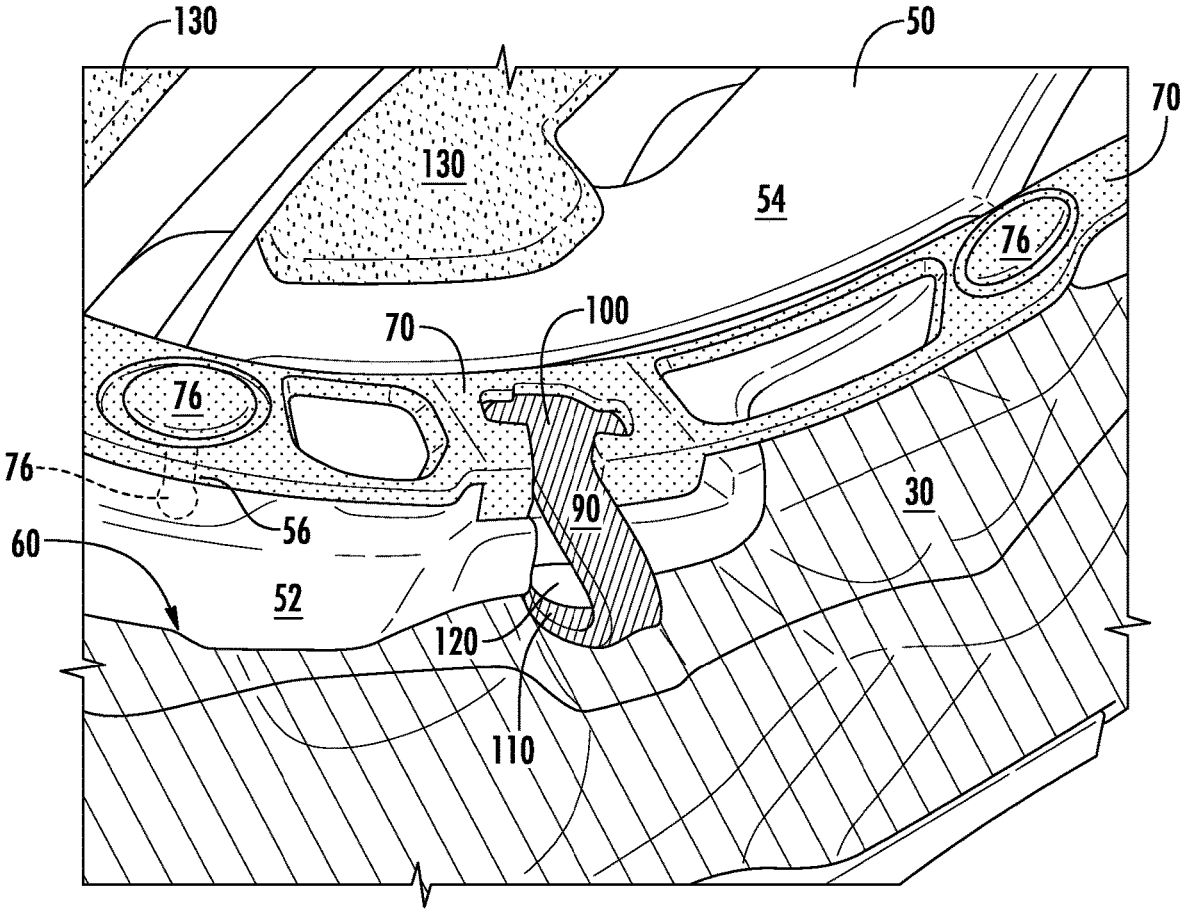
FIG. 8 shows a perspective view of an elastomeric strap coupled to a fit belt.
Figure 9:
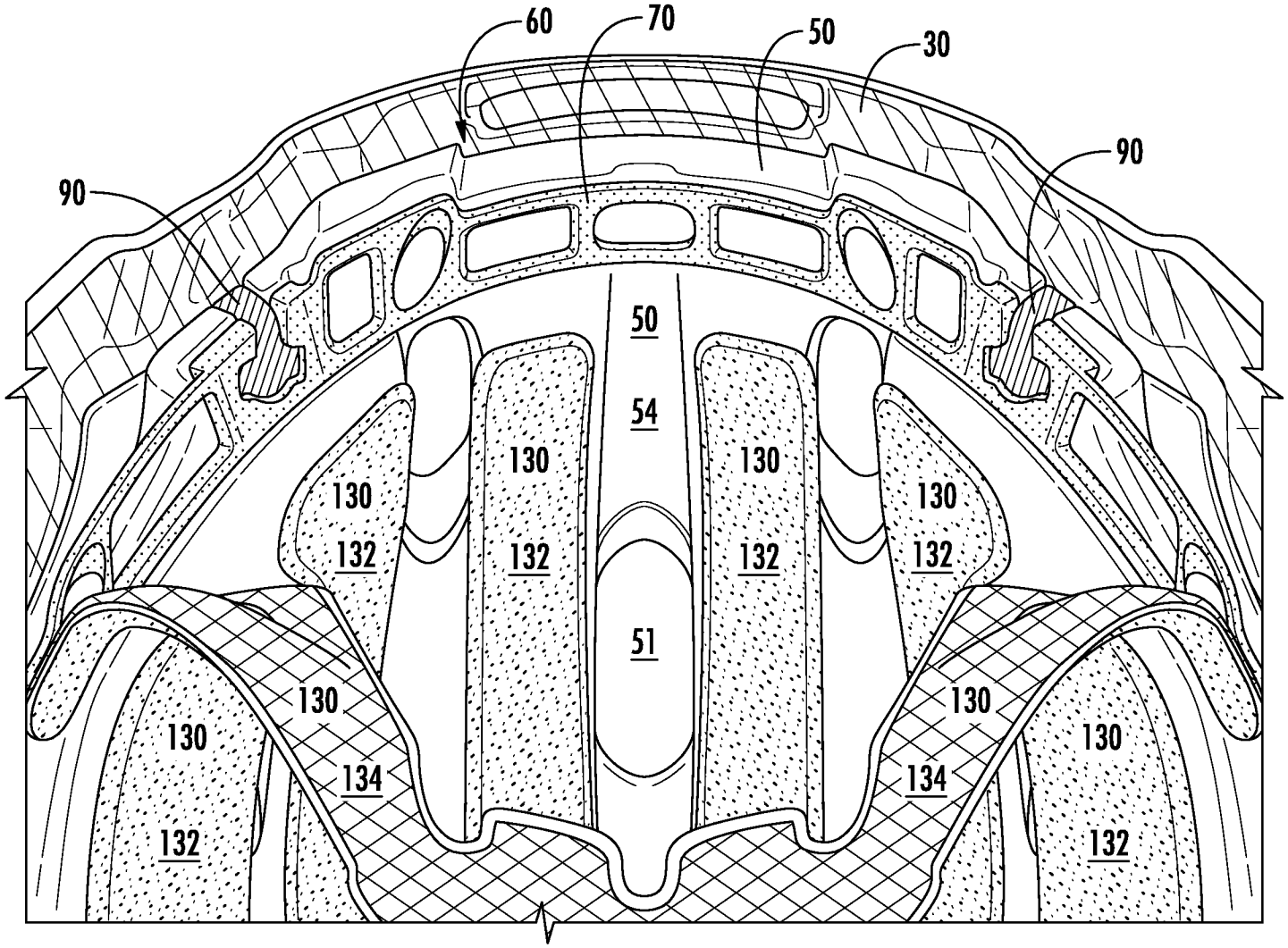
FIG. 9 shows an inner helmet liner coupled to an outer helmet liner with a plurality of elastomeric straps.

The inner liner 50 also comprises a lower edge 58, which may be adjacent the fit belt 70 and the one or more holes 56 and elastomeric straps 90 (shown, e.g., in FIGS. 7-9).

The outer liner 30 and the inner liner 50 may each be made of one or more layers of material, and may comprise a crushable foam, including EPS, EPP, or EPO. One or more of the outer liner 30 and the inner liner 50 may also comprise one or more relatively hard, impact-resistant outer shell or surface, including polycarbonate, KEVLAR, ABS plastic, carbon fiber, fiberglass, and the like, as well as any other suitable material.

The outer liner 30 and the inner liner 50 may further comprise a slip plane 60, which may be formed on, or at, outer surface 52 or inner surface 32. The slip plane 60 may also be an additional layer disposed between the outer liner 30 and the inner liner 50. The slip plane 60 may comprise mating surfaces of the inner liner 50 and the outer liner 30 and may further comprises a low friction thermoplastic material.

For particular implementations identified herein, the outer liner 30 and the inner liner 50 have mating spherical surfaces (such as at least a portion of the inner surface 32 of the outer liner 30 and the outer surface 52 of the inner liner 50), which aid in allowing the liner surfaces to rotate in relation to each other in any direction, or at least one desired direction.

Figure 2B:
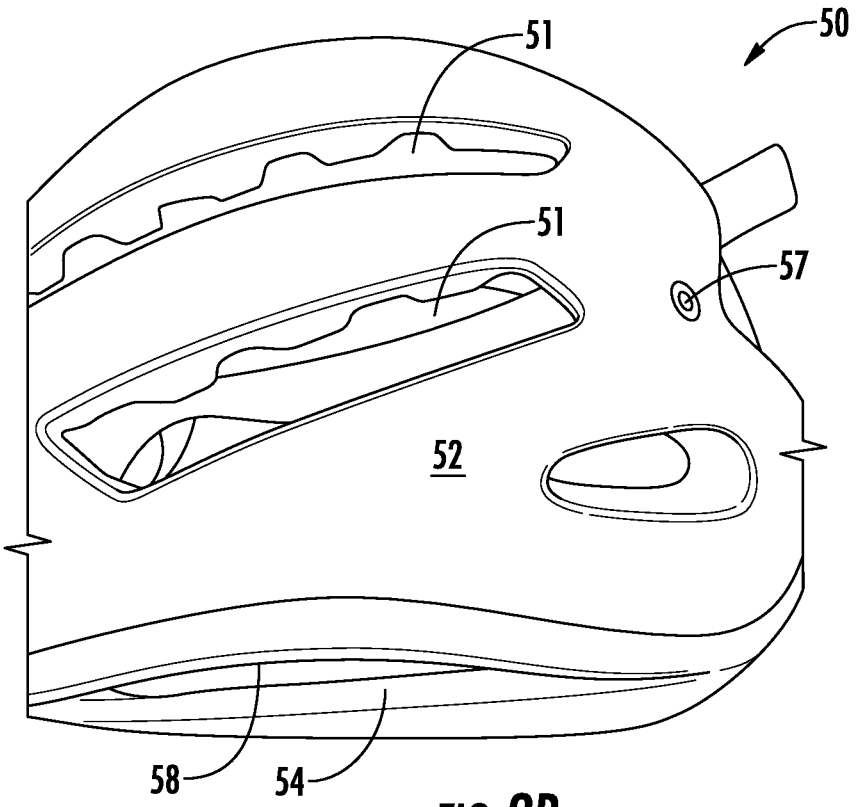

FIG. 2B illustrates a perspective view of a portion of the helmet 10, the view being shown of a portion of the outer surface 52 of the inner liner 50. The implementation shown in FIGS. 2A-2C is one in which the inner surface 32 of the outer liner 30 and the outer surface 52 of the inner liner 50 are spherical or comprise spherical surfaces.

Figure 2C:
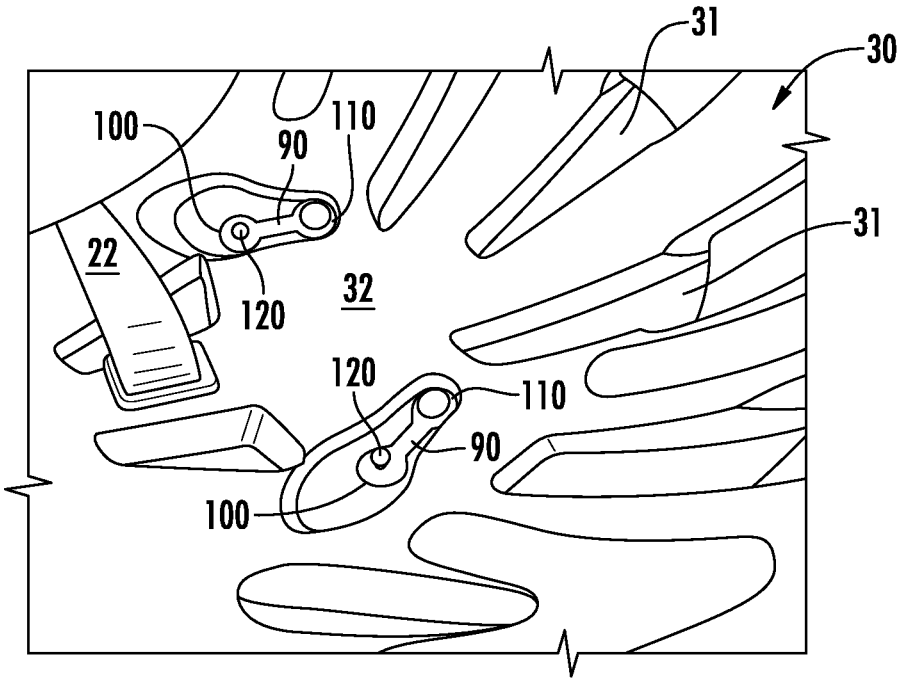

FIG. 2C illustrates a perspective view of a portion of the helmet 10, the view being shown into an interior portion and the inner surface 32 of the outer liner 30. The inner surface 32 of the outer liner 30 may be mateably coupled to the outer surface 52 of the inner liner 50 shown in FIG. 2B. Two elastomeric straps 90 are shown coupled to the inner surface 32 of the outer liner 30. Other implementations may mimic shapes with other curved surfaces which allow a similar rotation, such as a spheroid, ovoid, or ellipsoid. In some implementations, the outer surface 52 of the inner liner 50 is also made with a thermoplastic such as polycarbonate, as further illustrated in FIG. 2B. This thermoplastic may be coated with a low friction coating such as MIPS proprietary "C2" to help reduce the friction between the two surfaces.

In particular implementations, the outer liner 30 and the inner liner 50 are coupled or connected to each other through the use of elastomeric straps 90. An example of these elastomeric straps is disclosed in U.S. Provisional Patent Application No. 62,686,425, filed on Jun. 18, 2018, the disclosure of which is hereby incorporated by reference herein. The elastomeric straps 90 deform to allow the outer liner 30 to move with respect to the inner liner 50. In addition, the elastomeric straps 90 pull the outer liner 30 back to the outer liner's original position once the force causing the deformation is removed.

Figure 3:
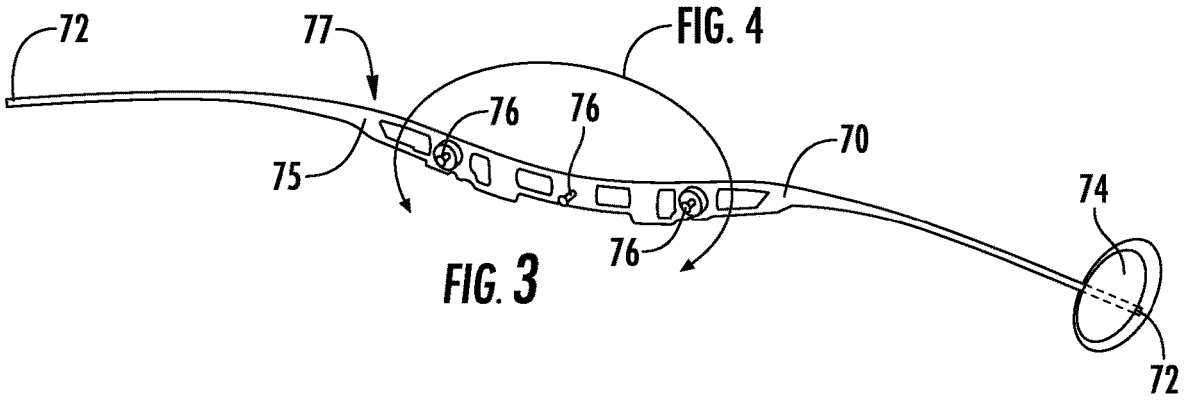
FIG. 3 is perspective view of fit belt for a helmet.

In addition to the implementations contained in the disclosure of the provisional patent application incorporated by reference above, the present disclosure includes embodiments of elastomeric straps 90 and a fit belt 70 that are explained more fully with respect to, e.g., FIGS. 3-6. The fit belt 70 may be made of plastic, metal, fiber, wood, or other suitable material. FIG. 3 illustrates a specific embodiment of the fit belt 70, in which the fit belt 70 comprises ends 72, which may be inserted into a fit system 74 that adjusts the perimeter of the fit belt 70 by drawing in or letting out the ends 72 of the fit belt 70. The fit belt 70 comprises an outer surface 75 and an inner surface 77 opposite the outer surface 75. The inner surface 77 is oriented towards the head of the user 2, and may be covered entirely or partially with comfort padding 130. The outer surface 75 of the fit belt 70 is oriented towards one or more of the outer liner 30 and the inner liner 50, such as the inner surface 54 of the inner liner 50.

The outer surface 75 of the fit belt 70 may comprise one or more pins 76 that may be inserted within, or coupled to, the at least one hole 36 in inner surface 32 of outer liner 30 near lower edge 38 (see, e.g. FIG. 7). The pins 76 may be of unitary construction or integrally formed with the fit belt 70, and in other instances, pins 76 may be part of a separate element or member that is coupled with the fit belt 70 and one or more liners 30, 50.

Figure 4:
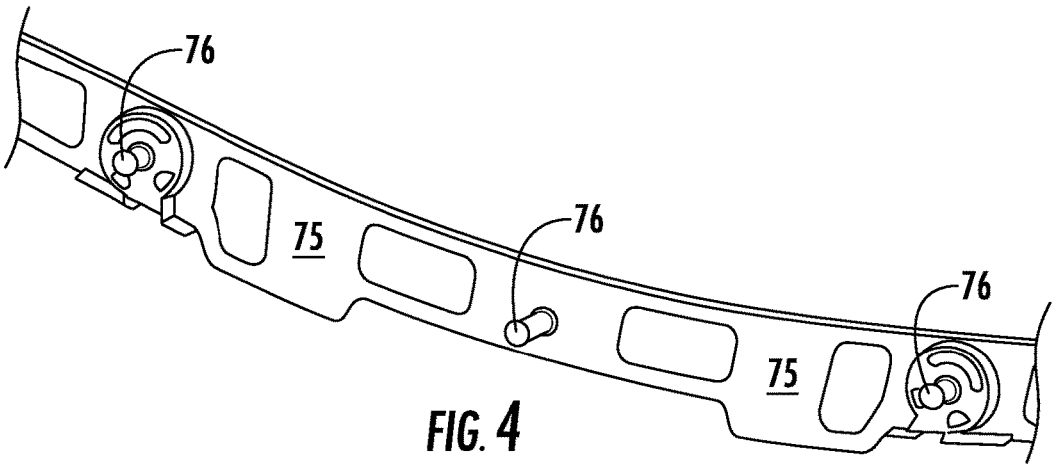
FIG. 4 is a close up of a portion of an outer surface of the fit belt shown in FIG. 3.
Figure 5:
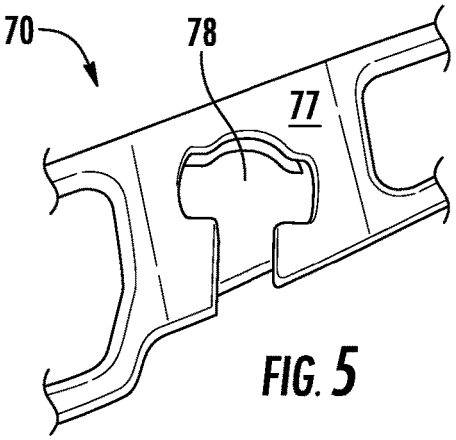
FIG. 5 is a is a close up of a portion of an inner surface of the fit belt shown in FIG. 3.

FIG. 4 illustrates a close-up view of the outer surface 75 of the fit belt 70, which outer surface 75 includes pins 76, the view of FIG. 4 being taken along the section line shown in FIG. 3. FIG. 5 illustrates a close-up view of the inner surface 77 of the fit belt 70, opposite the view of FIG. 4, which includes recess or holding area 78 for receiving inner end or first end 100 of elastomeric strap 90.

The fit belt pins 76 may be inserted through corresponding holes 56 in the inner liner 50 and snaps may be pressed onto the ends of the pins 76 to secure them in place, thus coupling the fit belt 70 with the inner liner 50. Alternatively, the corresponding holes 56 may contain snaps which may receive the pins 76 and lock them into place. The fit belt 70 may be coupled with the inner liner 50 in other ways as well. The recess 78 on the inner surface 77 of the fit belt 70 may also, or then, be used to secure inner end or first end 100 of elastomeric strap 90 to the fit belt 70, thus coupling the outer liner 30 to the inner liner 50. In addition, the ends 72 of the fit belt 70 may be inserted into a fit system 74 capable of adjusting the perimeter of the fit belt 70 by drawing in or letting out the ends of the fit belt 70. As used herein, the ends 72 of the fit belt 70 may be the terminal surface of the fit belt 70, as well as being "near," "about," or "substantially" at the terminal surface. As used herein, "near," "about," and "substantially" mean within 1-5%, 1-10% 1-20%, or 1-30% of the measure or length of the feature, such as from the terminal surface of the fit belt 70 down or along a length of the fit belt 70, or from a terminal surface of the elastomeric strap 90 down or along a length of the elastomeric strap.

In any event, holes 36, 56, 57, and 78, as well as pins 76 and fasteners 120, may be interchanged with respect to extending and receiving ends (male/female ends), and may further comprise snaps or other suitable mechanical fasteners, a POSA understanding relative positions of the holes 36, 56, 57, and 78 may be reversed with pins 76 and fasteners 120.

Figure 6:
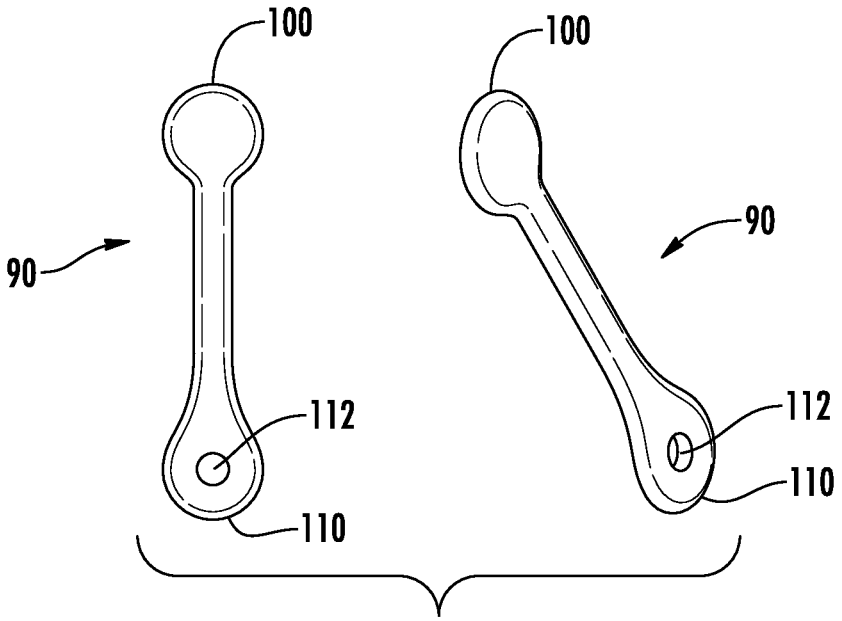
FIG. 6 shows various views of elastomeric straps.

FIG. 6 illustrates an implementation of the elastomeric strap 90 that may be used to couple the inner liner 50 and outer liner 30 together at points located along one or more of the lower edge 38 of the outer liner and the lower edge 58 of the inner liner 50. In the implementation shown in FIG. 6, the elastomeric strap 90 includes an inner end or first end 100 of elastomeric strap 90, an outer end or second end 110 of elastomeric strap 90, a recess or holding area 78 in outer end 110 of the elastomeric strap 90. The recess or hole 112 may be configured to receive a fastener (or strap pin) 120 that extends through the recess or hole 112 to couple the outer end 110 of the elastomeric strap 90 to the hole 36 in the outer liner 30. The elastomeric strap 90 can provide relative movement between the outer liner 30 and the inner liner 50 in a range of 0-30 mm, or 1-20 mm. The relative or dynamic movement of the helmet 10 between the outer liner 30 and the inner liner 50 may help to limit injuries to the user 2 upon impact because more of the impact energy is deflected away from the user by being transferred to the dynamic rotational movement of the helmet, and into the elastic deformation of the elastomeric straps 90. Additionally, by coupling elastomeric straps 90 to the fit belt 70, comfort of the user 70 and a desired fit between the helmet 10 and the head of the user 2 is not compromised.

As illustrated in FIG. 7, a perspective view of the front rim of the helmet 10 is shown, looking into an interior portion of the outer liner 30 of the helmet 10. When the elastomeric strap 90 is used to couple the inner liner 50 and the outer liner 30 together, a snap pin or other fastener 120 may be inserted through the recess 112 in the outer end 110 and snapped into the outer liner 30. The inner end 100 of the elastomeric band 90 (as shown) may be formed without a recess 112, and therefore not receive a snap, pin, or other fastener 120, but may subsequently be coupled to the fit belt 70, as shown in FIG. 8.

As illustrated in FIG. 8, a perspective view of a portion of the helmet 10 and its lower edge is shown, with the elastomeric band 90 curled around the lower edge 58 of the inner liner 50 and the fit belt 70, and the inner end 100 of the elastomeric band 90 may be pressed into the recess or holding area 78 of the fit belt 70, as illustrated in FIG. 8. The inner liner 50 and the outer liner 30 of the illustrated implementation are thus coupled together with the outer liner 30 being shown in FIG. 8 with cross-hatching, and the inner liner 50 being shown without cross-hatching.

In other implementations, one or both of the inner end 100 and the outer end 110 of the elastomeric strap 90 may be coupled with the fit belt 70, the inner liner 50, and/or the outer liner 30 using snap pins, adhesives, recesses, or any other form of fastening. In addition, other implementations do not have an elastomeric band 90 that curls around the lower edge 58 of the inner liner 50 and fit belt 70, but rather connects the outer liner 30 to the inner liner 50 and the fit belt 70 in another way. For example, the elastomeric strap 90 may connect an outer end or second end 110 to the outer liner 30 and connect to the other inner end or first end 100 to the inner liner 50 without wrapping around any edge. Alternatively, the elastomeric strap 90 may connect to the outer liner 50, extend through a hole in the inner liner 50, and then connect to the fit belt 70. Other implementations may join the outer liner 30, the inner liner 50, and the fit belt 70 in other ways as well.

The outer liner 30 is therefore free to move with respect to the inner liner 50 because the outer liner 30 and inner liner 50 are not directly, rigidly connected, being coupled by one or more of the slip plane 60, the fit belt 70, and the elastomeric strap 90. As such, the motion of the outer liner 30 is constrained by the extent to which the elastomeric strap 90 can or does deform. The cycling helmet 2 may include one, two, three, or more elastomeric straps 90 located around the lower edge of the helmet, which may be coextensive with all or part of the lower edge 38 of the outer liner 30, the lower edge 58 of the inner liner 50, or both.

FIG. 9 shows a perspective view of a front portion of the helmet 10, looking into the inner portion of the helmet 10 that receives the head of the user 2, the lower edge 38 of the outer liner 30 and the lower edge 58 of the inner liner 50 being shown adjacent the fit belt 70, a piece or portion of comfort padding 130 being shown pulled away from the fit belt 70. An inner surface of the comfort padding 132 is shown with stippling, and will be adjacent or oriented towards the head of the user 2 when the helmet 10 is worn. An outer surface 134 of the comfort padding 130 is shown with square patterning, and will be adjacent the inner surface 54 of the inner liner 50 and oriented away from the head of the user 2 when the helmet 10 is worn.

The implementation illustrated in FIG. 9 also shows two elastomeric straps 90 disposed towards the front portion of the helmet 10. Other implementations may include more or fewer elastomeric straps 90, and they may be located at other points around the lower edge of the helmet. In addition, some implementations may couple the inner liner 50 and the outer liner 30 using other methods. For example, in addition to being coupled at locations where the elastomeric straps 90 couple the inner liner 50 and outer liner 30 together, the outer liner 30 and the inner liner 50 may be coupled together by a fit system or a chin strap using methods that are known in the art.

FIG. 9 also shows the fit belt 70 coupled to the outer liner 30 and the inner liner 50 with the outer end 110 of the elastomeric strap 90 disposed between the outer liner 30 and the inner liner 50, where each outer end 112 is coupled to the outer liner 30 with fasteners 120. The fasteners 120 extend through the recess 112 of the outer end 110 of the elastomeric strap 90 to couple the elastomeric strap 90 to the outer liner 30. At least one pin 76 of the fit belt 70 is coupled to the inner surface 54 of the inner liner 50 at a corresponding at least one hole 56 mateably coupled with the at least one pin 76. The elastomeric strap 90 further comprises the inner end 110 opposite the outer end 112, the inner end 100 of the elastomeric strap 90 being coupled to the recess 112 in the fit belt 70.

As such, the present disclosure concerns a cycling helmet 10 with spherical surface rotational impact attenuation. A variety of different implementations may be used, and as discussed herein, may generally comprise an outer liner 30, an inner liner 50, elastomeric straps 90, and a fit belt 70. Such implementations generally function by allowing the outer liner 30 to rotate in relation to the inner liner 50. This dynamic movement of the helmet 10 may help to limit injuries upon impact because more of the impact energy is absorbed than with a conventional cycling helmet. It should be understood that the components depicted and discussed are non-limiting examples, and that the contemplated components may be combined with any of the other components in other implementations.

It will be understood that cycling helmet implementations are not limited to the specific components disclosed herein, as virtually any components consistent with the intended operation of the various cycling helmet implementations may be utilized. Accordingly, for example, it should be understood that, while the drawings and accompanying text show and describe particular cycling helmet implementations, any such implementation may comprise any shape, size, style, type, model, version, class, grade, measurement, concentration, material, weight, quantity, and/or the like consistent with the intended operation of cycling helmet implementations.

The concepts disclosed herein are not limited to the specific cycling helmet implementations shown herein. For example, it is specifically contemplated that the components included in particular cycling helmet implementations may be formed of any of many different types of materials or combinations that can readily be formed into shaped objects and that are consistent with the intended operation of the cycling helmet implementations. For example, the components may be formed of: silicones and/or other like materials; rubbers (synthetic and/or natural) and/or other like materials; elastomers and/or other like materials; polymers and/or other like materials; plastics and/or other like materials; composites and/or other like materials; and/or any combination of the foregoing.

Furthermore, cycling helmet implementations may be manufactured separately and then assembled together, or any or all of the components may be manufactured simultaneously and integrally joined with one another. Manufacture of these components separately or simultaneously, as understood by those of ordinary skill in the art, may involve extrusion, pultrusion, vacuum forming, injection molding, blow molding, resin transfer molding, and/or the like. If any of the components are manufactured separately, they may then be coupled or removably coupled with one another in any manner, such as with adhesive, a plastic weld, a fastener, any combination thereof, and/or the like for example, depending on, among other considerations, the particular material(s) forming the components.

In places where the description above refers to particular cycling helmet implementations, it should be readily apparent that a number of modifications may be made without departing from the spirit thereof and that these implementations may be applied to other implementations disclosed or undisclosed. The presently disclosed cycling helmet implementations are, therefore, to be considered in all respects as illustrative and not restrictive.

What is claimed is:

1. A helmet comprising:

an outer liner comprising crushable foam;

an inner liner disposed inward from and nested within the outer liner such that the outer liner is stacked on top of the inner liner, the inner liner rotatable with respect to the outer liner, the inner liner comprising crushable foam and defining an inner surface with at least one hole;

a fit belt comprising a first end and a second end opposite the first end and at least one pin between the first and second end, the pin coupled to the inner surface of the inner liner at a lower edge of a front portion of the helmet with the at least one hole of the inner liner mateably coupled with the at least one pin; and an elastomeric strap comprising an inner end and an outer end opposite the inner end between the outer liner and the inner liner, wherein:

the outer end of the elastomeric strap is coupled to an inner surface of the outer liner, the outer end of the elastomeric strap comprising a recess and a fastener that extends through the recess of the outer end of the elastomeric strap to couple the elastomeric strap to the outer liner at a lower edge thereof at the front portion of the helmet, and the inner end of the elastomeric strap is coupled to the fit belt at the lower edge of the front portion of the helmet, such that the elastomeric strap is disposed around a lower edge of the inner liner.

2. The helmet of claim 1, further comprising:

a slip plane disposed between the inner surface of the outer liner and an outer surface of the inner liner, wherein the slip plane comprises mating surfaces of the inner liner and the outer liner and further comprises a low friction thermoplastic material.

3. The helmet of claim 1, further comprising one or more of the inner liner and the outer liner formed of expanded polystyrene (EPS), expanded polypropylene (EPP), or expanded polyolefin (EPO).

4. The helmet of claim 1, wherein the inner liner and the outer liner comprise mating spherical surfaces which aid in allowing the mating spherical surfaces of the inner liner and of the outer liner to rotate in relation to each other in any direction.

5. The helmet of claim 1, wherein the elastomeric strap provides relative movement between the outer liner and the inner liner in a range of 0-30 millimeters.

6. The helmet of claim 1, the fit belt having ends, wherein the ends of the fit belt are inserted into a fit system that adjusts a perimeter of the fit belt by drawing in or letting out the ends of the fit belt.

7. The helmet of claim 1, wherein the elastomeric strap is coupled to the inner liner and the outer liner at points located along a lower edge of the helmet.

8. A helmet comprising:

an outer liner comprising crushable foam;

an inner liner disposed inward from and nested within the outlet liner, the inner liner rotatable with respect to the outer liner, and comprising crushable foam;

a fit belt coupled to an inner surface of the inner liner at a lower edge of a front portion of the helmet; and an elastomeric strap comprising an inner end and an outer end opposite the inner end wherein:

the outer end of the elastomeric strap is coupled to an inner surface of the outer liner at a lower edge thereof at a front portion of the helmet, and the inner end of the elastomeric strap is coupled to the fit belt at the lower edge of the front portion of the helmet, such that the elastomeric strap is curled around the lower edge of the inner liner and the fit belt, such that the elastomeric strap is curled around the lower edge of the inner liner and the fit belt.

9. The helmet of claim 8, wherein the inner liner and the outer liner comprise mating surfaces comprising a spheroid, ovoid, or ellipsoid contour which aids in allowing the mating surfaces of the inner liner and of the outer liner to rotate in relation to each other in at least one desired direction.

10. The helmet of claim 8, wherein the inner liner and the outer liner comprise mating surfaces comprising a low friction material.

11. The helmet of claim 8, further comprising:

the outer end of the elastomeric strap comprises a recess; and a fastener that extends through the recess of the outer end of the elastomeric strap to couple the elastomeric strap to the outer liner.

12. The helmet of claim 8, wherein the elastomeric strap provides relative movement between the outer liner and the inner liner in a range of 0-30 millimeters.

13. The helmet of claim 8, wherein the elastomeric strap is coupled to the inner liner and the outer liner at points located along a lower edge of the helmet.

* * * * *